US007303469B2

(12) United States Patent
Kaminkow

(10) Patent No.: US 7,303,469 B2
(45) Date of Patent: Dec. 4, 2007

(54) GAMING DEVICE HAVING A MULTIPLE SELECTION GROUP BONUS ROUND

(75) Inventor: Joseph E. Kaminkow, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 10/327,538

(22) Filed: Dec. 20, 2002

(65) Prior Publication Data

US 2003/0100358 A1 May 29, 2003

Related U.S. Application Data

(63) Continuation of application No. 09/605,107, filed on Jun. 28, 2000, now Pat. No. 6,511,375.

(51) Int. Cl.
*A63F 9/24* (2006.01)

(52) U.S. Cl. ..... 463/20

(58) Field of Classification Search ..... 463/9–13, 463/16–20, 25, 26, 30, 31, 35, 27, 21; 273/143 R, 273/138.1, 138.2, 139, 236, 237; 283/903
See application file for complete search history.

(56) References Cited

U.S. PATENT DOCUMENTS

| | | | | |
|---|---|---|---|---|
| 2,545,644 | A | 3/1951 | Benton et al. | |
| 3,975,022 | A | 8/1976 | Figueroa | |
| 4,321,673 | A * | 3/1982 | Hawwass et al. | 463/22 |
| 4,410,178 | A | 10/1983 | Partridge | |
| 4,695,053 | A | 9/1987 | Vazquez, Jr. et al. | |
| 4,732,386 | A | 3/1988 | Rayfiel | |
| 4,775,155 | A | 10/1988 | Lees | |
| 5,046,737 | A | 9/1991 | Fienberg | |

(Continued)

FOREIGN PATENT DOCUMENTS

DE 38 04 862 A1 10/1988

(Continued)

OTHER PUBLICATIONS

Sphinx Brochure, published by Atronic Casino Technology (1997), pp. 1-2.*

(Continued)

*Primary Examiner*—Corbett B. Coburn
*Assistant Examiner*—Jasson H. Yoo
(74) *Attorney, Agent, or Firm*—Bell, Boyd & Lloyd LLP

(57) ABSTRACT

The present invention provides a gaming device bonus round that contains a plurality of groups each having a plurality of selections that the player can pick and receive an award. The groups and selections form a theme that provides enjoyment and excitement to the player. The game enables the player to pick a predetermined number of selections from each group. After the player picks from each selection group, the game uncovers, reveals and awards an award hidden underneath and the awards of selections that the player did not choose. The bonus round includes audio and visual displays, in accordance with the game theme, that either direct or follow along with the player's progress of the bonus round. As the player proceeds through the bonus round, the game accumulates the awards and displays the accumulation at the end of the round.

36 Claims, 9 Drawing Sheets

U.S. PATENT DOCUMENTS 5,102,137 A 4/1992 Ekiert
5,152,529 A 10/1992 Okada
5,205,555 A 4/1993 Hamano
5,342,047 A 8/1994 Heidel et al.
5,364,100 A 11/1994 Ludlow et al.
5,395,111 A 3/1995 Inoue
5,449,173 A 9/1995 Thomas et al.
5,536,016 A 7/1996 Thompson
5,560,603 A 10/1996 Seelig et al.
5,584,763 A 12/1996 Kelly et al.
5,611,535 A 3/1997 Tiberio
5,664,998 A 9/1997 Seelig et al.
5,766,074 A 6/1998 Cannon et al.
5,788,573 A 8/1998 Baerlocher et al.
5,823,872 A 10/1998 Prather et al.
5,823,874 A 10/1998 Adams et al.
D400,597 S 11/1998 Hedrick et al.
D402,702 S 12/1998 Seelig et al.
5,848,932 A 12/1998 Adams
5,851,148 A 12/1998 Brune et al.
5,855,514 A 1/1999 Kamille
5,873,781 A 2/1999 Keane
D406,865 S 3/1999 Heidel
5,882,261 A 3/1999 Adams
5,911,418 A 6/1999 Adams et al.
5,927,714 A 7/1999 Kaplan
5,947,820 A 9/1999 Morro et al.
5,976,015 A 11/1999 Seelig et al.
5,984,781 A 11/1999 Sunaga
5,996,997 A * 12/1999 Kamille ..... 273/139
5,997,401 A 12/1999 Crawford
6,004,207 A 12/1999 Wilson, Jr. et al.
6,015,346 A 1/2000 Bennett
6,033,307 A 3/2000 Vancura
6,059,289 A 5/2000 Vancura
6,059,658 A 5/2000 Mangano et al.
6,086,066 A 7/2000 Takeuchi et al.
6,089,976 A 7/2000 Schneider et al.
6,089,977 A 7/2000 Bennett
6,089,978 A 7/2000 Adams et al.
6,102,798 A 8/2000 Bennett
6,105,962 A 8/2000 Malavazos et al.
6,113,098 A 9/2000 Adams
6,126,542 A 10/2000 Fier
6,142,873 A 11/2000 Weiss et al.
6,142,874 A 11/2000 Kodachi et al.
6,149,156 A * 11/2000 Feola ..... 273/292
6,155,925 A 12/2000 Giobbi et al.
6,159,095 A 12/2000 Frohm et al.
6,159,097 A * 12/2000 Gura ..... 463/20
6,159,098 A 12/2000 Slomiany et al.
6,162,121 A 12/2000 Morro et al.
6,168,523 B1 1/2001 Piechowiak et al.
6,173,955 B1 1/2001 Perrie et al.
6,174,234 B1 1/2001 Seibert, Jr. et al.
6,174,235 B1 * 1/2001 Walker et al. ..... 463/25
6,190,254 B1 2/2001 Bennett
6,190,255 B1 * 2/2001 Thomas et al. ..... 463/20
6,203,429 B1 3/2001 Demar et al.
D441,031 S 4/2001 Seelig et al.
6,213,876 B1 4/2001 Moore, Jr.
6,220,593 B1 4/2001 Pierce et al.
6,224,483 B1 5/2001 Mayeroff
6,227,970 B1 5/2001 Shimizu et al.
6,231,442 B1 5/2001 Mayeroff
6,231,445 B1 5/2001 Acres
D443,313 S 6/2001 Brettschneider
6,251,013 B1 6/2001 Bennett
6,254,481 B1 7/2001 Jaffe
6,260,296 B1 7/2001 Carney, Jr.
6,261,177 B1 7/2001 Bennett
6,267,669 B1 7/2001 Luciano, Jr. et al.
6,270,411 B1 8/2001 Gura et al.
6,299,165 B1 10/2001 Nagano
6,302,790 B1 10/2001 Brossard
6,305,686 B1 10/2001 Perrie et al.
6,309,300 B1 10/2001 Glavich
6,312,334 B1 11/2001 Yoseloff
6,315,660 B1 11/2001 DeMar et al.
6,315,663 B1 11/2001 Sakamoto
6,315,664 B1 11/2001 Baerlocher et al.
6,319,124 B1 11/2001 Baerlocher et al.
6,336,863 B1 1/2002 Baerlocher et al.
6,340,158 B2 1/2002 Pierce et al.
6,343,988 B1 2/2002 Walker et al.
6,346,043 B1 2/2002 Colin et al.
6,347,996 B1 2/2002 Gilmore et al.
6,364,766 B1 4/2002 Anderson et al.
6,364,767 B1 4/2002 Brossard et al.
6,368,216 B1 4/2002 Hedrick et al.
6,386,974 B1 5/2002 Adams
6,398,220 B1 6/2002 Inoue
6,419,579 B1 7/2002 Bennett et al.
6,439,995 B1 8/2002 Hughs-Baird et al.
6,457,714 B1 * 10/2002 Feola ..... 273/274
6,464,582 B1 10/2002 Baerlocher et al.
D465,531 S 11/2002 Luciano, Jr. et al.
6,481,713 B2 11/2002 Perrie et al.
6,506,118 B1 1/2003 Baerlocher et al.
6,514,141 B1 2/2003 Kaminkow et al.
6,533,660 B2 3/2003 Seelig et al.
6,537,152 B2 3/2003 Seelig et al.
6,575,830 B2 6/2003 Baerlocher et al.
6,582,307 B2 6/2003 Webb
6,585,591 B1 7/2003 Baerlocher et al.
6,599,185 B1 7/2003 Kaminkow et al.
6,602,137 B2 8/2003 Kaminkow et al.
6,609,972 B2 8/2003 Seelig et al.
6,712,694 B1 3/2004 Nordman
6,731,313 B1 5/2004 Kaminkow
6,802,775 B2 10/2004 Baerlocher et al.

FOREIGN PATENT DOCUMENTS

DE 38 11 301 A1 10/1989
DE 44 02 800 A1 8/1995
EP 0688002 A1 12/1995
EP 0 945 837 A2 9/1999
EP 0945837 A2 9/1999
EP 0984409 A2 3/2000
GB 371 199 A 4/1932
GB 762 611 A 11/1956
GB 912 685 12/1962
GB 2117952 A * 10/1983
GB 2201821 A 9/1987
GB 2262642 A 6/1993
GB 2383668 A 11/2001
JP 8 160893 6/1996
JP 8 215404 8/1996
JP 10 328399 12/1998

OTHER PUBLICATIONS

Jackpot Party Brochures and Articles written WMS Gaming, Inc., published in 1998.
Caribbean Gold Brochure written by Aristocrat, published in 1998.
Top Dollar Brochure written by IGT, published in 1998.
The Jeopardy! Database of Champions (website) written by www.fiendation.com, printed Mar. 21, 2002.
4DU Dice Unit advertisement written by starpoint.uk.com, printed on Sep. 3, 2002.
American Bandstand advertisement written by Anchor Games, published in 2001.
Big Shot!™ Advertisement published by Aristocrat Technologies, Inc., published in 2002.

Big Top Keno Advertisement published by Aristocrat Technologies, Inc., published in 2000.
Bonus Roulette advertisement written by R. Franco, available prior to Dec. 20, 2002.
Buck's Roulette advertisement written by R. Franco, available prior to Dec. 20, 2002.
Chariot's of Fortune advertisement written by R. Franco, available prior to Dec. 20, 2002.
Classic Pot of Gold advertisement written by Ace Coin Equipment Ltd., available prior to Dec. 20, 2002.
Cyberdyne Gaming advertisement written by Cyberdyne Gaming, available prior to Dec. 20, 2002.
Elvira® Mistress of the Dark™ advertisement written by IGT, published in 2002.
Elvis Hits Advertisement written by IGT, published in 1999.
Holy Smoke advertisement written by Impulse Gaming LTD., available prior to Dec. 20, 2002.
Jack and the Beanstalk™ advertisement written by AC Coin & Slot, available prior to Dec. 20, 2002.
King of the Grill™ advertisement written by AC Coin & Slot, available prior to Dec. 20, 2002.
Line-Up advertisement written by AC Coin & Slot, available prior to Dec. 20, 2002.
Little Green Men Jr.™ advertisement written by AC Coin & Slot, available prior to Dec. 20, 2002.
Little Green Men Jr.™ article written by Strictly Slots, published in Feb. 2003.
Mega Jackpots news article, published prior to Dec. 20, 2002.
Miss America advertisement written by AC Coin & Slot, available prior to Dec. 20, 2002.
Mix and Match advertisement written by AC Coin & Slot, available prior to Dec. 20, 2002.
Mix and Match article written by Strictly Slots, published in Apr. 2002.
Money Grab Article written by Strictly Slots, published in Apr. 2001.
Monster Match Article written by Strictly Slots, published in Jan. 2002.
On The Money! Article written by Strictly Slots, published in Dec. 2000.
Party Time Psycho Cash Beast advertisement written by IGT, published in 1999.
Payout!™ Advertisement written by www.csds.com/Gaming/Products/g Payout.htm, printed on Jan. 15, 2001.
Payout!™ article written by Casino Data Systems, published prior to Dec. 20, 2002.
Pick a Prize advertisement written by Acres Gaming Incorporated, available prior to Dec. 20, 2002.
Power Slotto advertisement published by AC Coin & Slot, available prior to Dec. 20, 2002.
Press Your Luck advertisement published by AC Coin & Slot, available prior to Dec. 20, 2002.
Quick Pick Paytime advertisement written by Acres Gaming Incorporated, available prior to Dec. 20, 2002.
R&B™ advertisement published by AC Coin & Slot, available prior to Dec. 20, 2002.
Reel Dice Advertisement written by Gerber & Glass, published in 1936.
Royal Roulette advertisement written by Impulse Gaming Ltd., available prior to Dec. 20, 2002.
Silver City Roundup advertisement published by AC Coin & Slot, available prior to Dec. 20, 2002.
Slot Machine Buyer's Handbook, A Consumer's Guide to Slot Machines written by David L. Saul and Daniel R. Mead, published in 1998.
Slot Machines A Pictorial History of the First 100 Years, 5th edition written by Marshall Fey, published in 1983-1997.
Slot Machines on Parade, 1st edition written by Robert N. Geddes and illustrated by Daniel R. Mead, published in 1980.
Spin-A-Lot advertisement written by Acres Gaming Incorporated, available prior to Dec. 20, 2002.
Take Your Pick Article written by Strictly Slots, published in Mar. 2001.
Top Dollar Game advertisement written by IGT, published in 1998.
Wheel of Fortune advertisement written by IGT, published in 1998.
Wheel of Fortune advertisement written by IGT, published in 1999.
Wheel of Fortune Slots S2000 Series advertisement, published in 2002.
Wheel of Fortune Video Slots advertisement on the website http://www.igt.com/games/new_games/wheel.html, printed Mar. 21, 2001.
Yahtzee Bonus advertisement written by Mikohn, published in 1999.

* cited by examiner

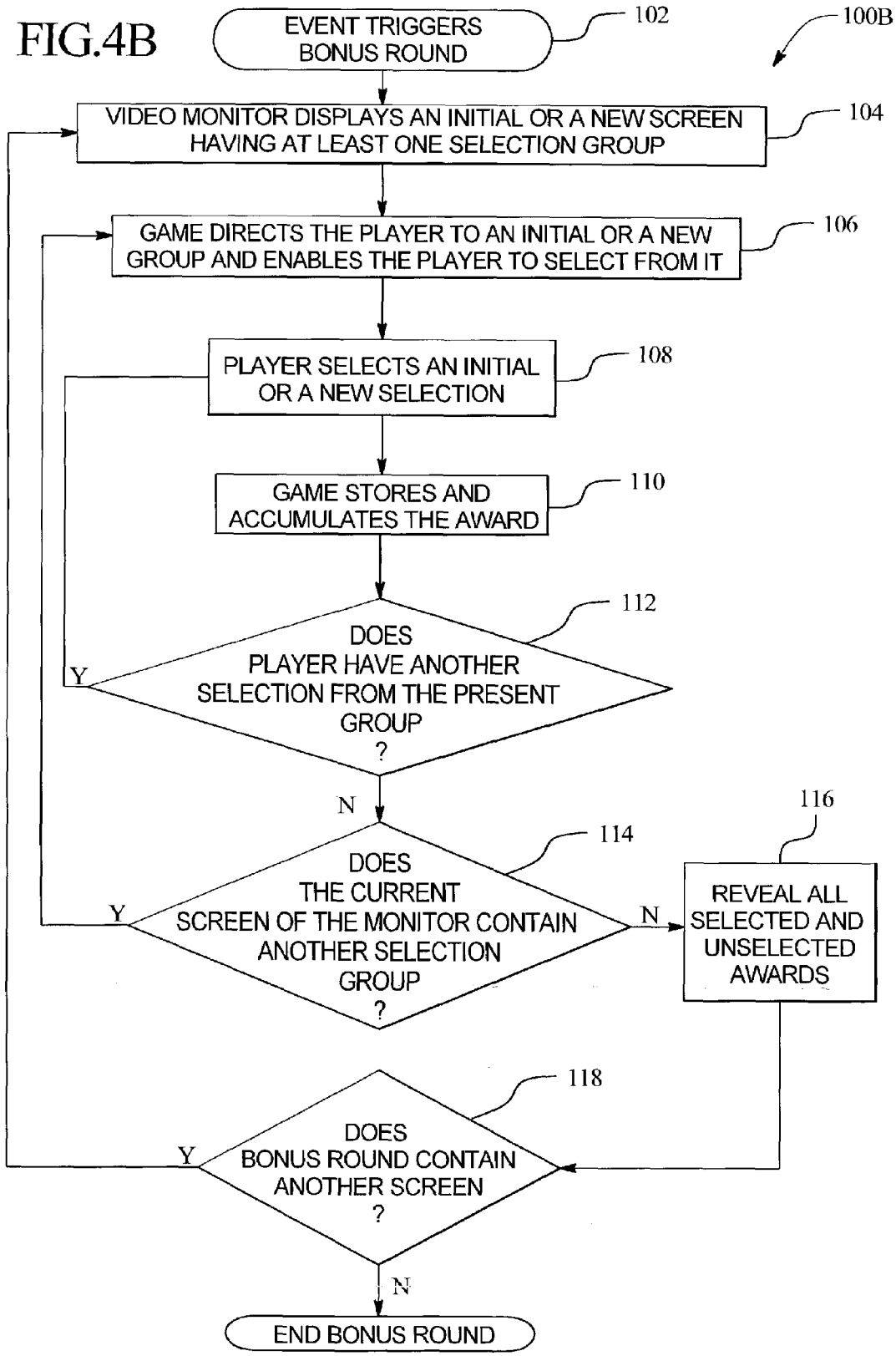
FIG.4B
EVENT TRIGGERS BONUS ROUND
102
100B
VIDEO MONITOR DISPLAYS AN INITIAL OR A NEW SCREEN HAVING AT LEAST ONE SELECTION GROUP
104
GAME DIRECTS THE PLAYER TO AN INITIAL OR A NEW GROUP AND ENABLES THE PLAYER TO SELECT FROM IT
106
PLAYER SELECTS AN INITIAL OR A NEW SELECTION
108
GAME STORES AND ACCUMULATES THE AWARD
110
DOES PLAYER HAVE ANOTHER SELECTION FROM THE PRESENT GROUP ?
112
Y
N
DOES THE CURRENT SCREEN OF THE MONITOR CONTAIN ANOTHER SELECTION GROUP ?
114
Y
N
REVEAL ALL SELECTED AND UNSELECTED AWARDS
116
DOES BONUS ROUND CONTAIN ANOTHER SCREEN ?
118
Y
N
END BONUS ROUND 32b
232b
500 CREDITS
432b
10 CREDITS
132b
150 CREDITS
332b
5 CREDITS
160
60
170
16

32c
232c
100 CREDITS
132c
20 CREDITS
180
60
190
16

32d
232d
100 CREDITS
132d
30 CREDITS
332d
50 CREDITS
280
60
290
16

32e
232e
10 CREDITS
432e
20 CREDITS
132b
50 CREDITS
332e
100 CREDITS
350
60
360
16

GAMING DEVICE HAVING A MULTIPLE SELECTION GROUP BONUS ROUND

PRIORITY CLAIMS

This application is a continuation of and claims the benefit of U.S. patent application Ser. No. 09/605,107, filed Jun. 28, 2000 now U.S. Pat. No. 6,511,375.

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having a bonus round with multiple selection groups, wherein each group includes a plurality of awards producing selections.

BACKGROUND OF THE INVENTION

Gaming machines currently exist with bonus rounds in which a player has one or more opportunities to choose bonus awards that are initially masked from a group of symbols arranged in a pattern displayed to the player. When the player chooses a masked symbol from the pattern, the game removes the mask and either reveals (or awards) the player with a bonus value or reveals a bonus terminator which terminates the bonus round. The outcome depends upon whether the player picks an award or terminator. The controller of the gaming machine randomly places a predetermined number of bonus awards and bonus terminators in the pattern at the beginning of the bonus round and maintains the positioning until the bonus round terminates.

When the player picks a symbol that awards a bonus value, the player receives bonus credits and the bonus round typically displays a message that the player may continue and enables the player to pick another symbol. The player then picks another masked symbol, and the process continues until the player picks a bonus round terminator. European Patent Application No. EP 0 945 837 A2 filed on Mar. 18, 1999 and assigned on its face to WMS Gaming, Inc. discloses a bonus round of this type.

To increase player enjoyment and excitement, it is desirable to provide players with new bonus rounds where the players have multiple opportunities to receive winning payouts. In particular, it is desirable to provide players with opportunities to receive awards from multiple levels of the bonus round or from multiple groups of awards, wherein the multiple levels and multiple groups form a theme that provides entertainment and excitement to the player.

SUMMARY OF THE INVENTION

The present invention overcomes the above shortcomings by providing a bonus round that contains a plurality of selection groups (hereinafter collectively referred to as "selection groups" or "groups" or individually referred to as a "selection group" or "group"). Each group has a plurality of selections. The game provides the player with a number of picks or choices in each group which is preferably less than the number of selections in each group. The game preferably displays one screen on a video monitor that contains the groups. The present invention preferably does not include terminating symbols and has or contains a theme that ties or relates each of the selections, groups and screens together. The game preferably includes audio and visual displays (in accordance with the theme) that either direct or follow along with the player's progress of the bonus round.

More specifically, the game enables the player to pick a predetermined number of the selections from each group. When the player picks a selection, the game preferably stores the pick for a subsequent revealing of the award associated with the chosen selection.

In an alternative embodiment, the game removes the indicia of the selection and uncovers an award associated with said selection. As the player makes the picks, the game tallies the awards. The awards are either gaming device credits or multipliers that are multiplied by an amount that the player has bet yielding a number of gaming device credits. Before switching screens or at the end of a round, the game preferably removes the indicia of the picked or chosen selections and shows the player a total award.

In the preferred embodiment, the game directs the player through the bonus round and designates the group from which the player is currently enabled to pick. When the player exhausts the picks from a group, the game directs the player to another group and so on through each group in the screen (and if there are multiple screens, from each screen of the round) until no more picks exist.

In the preferred embodiment wherein the displays follow a player's progress through the round, the game enables the player to pick from each group in a screen, the game monitors the picks, and the audio-visual displays inform the player when a particular group is exhausted, so that the player can pick from another group. The game so informs the player until the player picks from each group in the screen (and if there are multiple screens, from each screen in the round) until no more picks exist.

In both embodiments described above, the game preferably reveals the awards of the selections not picked by the player when the game displays the awards. Revealing the awards for the selections that the player does not pick increases player excitement and enjoyment by showing the player lost opportunities and the player's relative success or failure in the bonus round.

It is therefore an object of the present invention to provide a gaming device with a bonus round that provides multiple groups, wherein each group has a plurality of selections, a predetermined number of which the player can pick to receive awards.

Another object of the present invention is to provide multiple groups of awards, wherein the multiple levels and multiple groups form a theme that provides entertainment and excitement to the player.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 4B is a flow diagram of an alternative embodiment of the present invention having multiple screens;

DETAILED DESCRIPTION OF THE INVENTION

Gaming Device and Electronics

Figure 1:
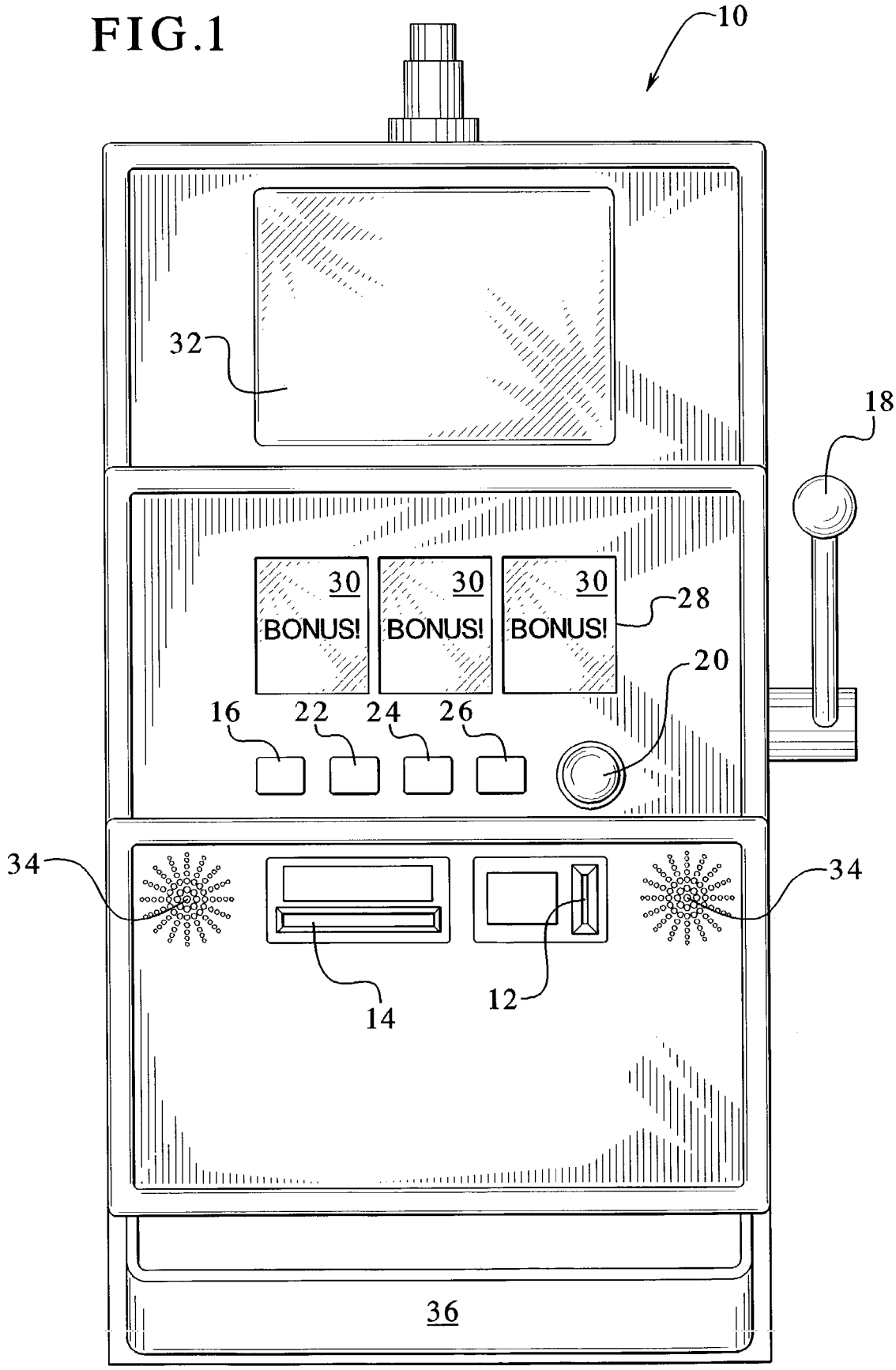
FIG. 1 is a front plan view of one embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown) which a player can operate preferably while sifting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any game such as slot, poker or keno in addition to any of their bonus triggering events which trigger the bonus round of the present invention. The symbols and indicia used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18, pushing play button 20. Play button 20 can be any play activator used by the player which starts any game or sequence of events in the gaming device.

As shown in FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a display window 28 which contains a plurality of reels 30, preferably three to five reels in mechanical or video form. Each reel 30 displays a plurality of indicia such as bells, hearts, fruits, numbers, letters, bars or other images which preferably correspond to a theme associated with the gaming device 10. If the reels 30 are in video form, the gaming device 10 preferably displays the video reels 30 at video monitor 32 instead of at display window 28. Furthermore, gaming device 10 preferably includes speakers 34 for making sounds or playing music.

At any time during the game, a player may "cash out" and thereby receive a number of coins corresponding to the number of remaining credits by pushing a cash out button 26. When the player "cashes out," the player receives the coins in a coin payout tray 36. The gaming device 10 may employ other payout mechanisms such as credit slips redeemable by a cashier or electronically recordable cards which keep track of the player's credits.

Figure 2:
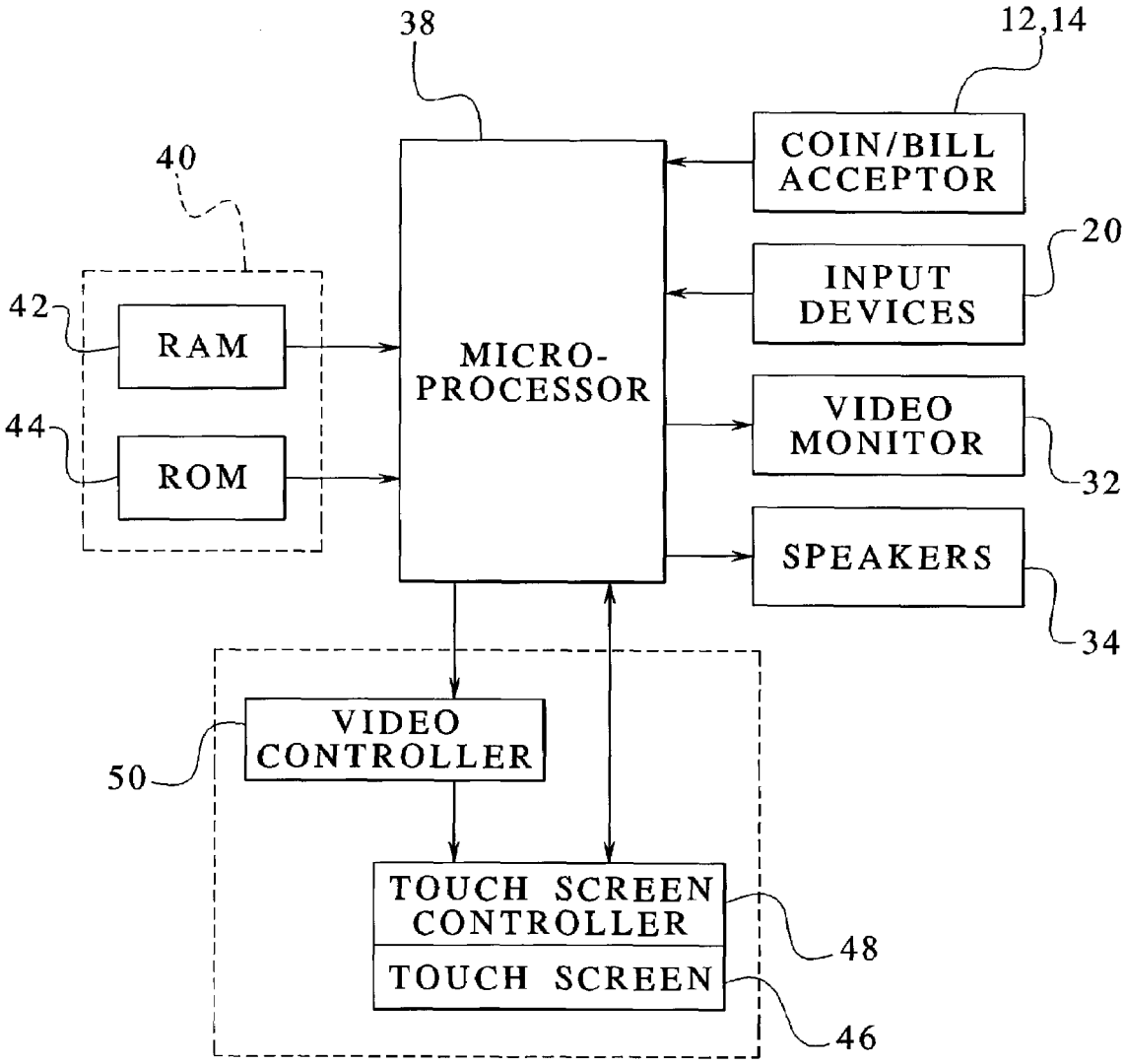
FIG. 2 is a schematic block diagram of the electronic configuration of one embodiment of the gaming device of the present invention.

With respect to electronics, the controller of gaming device 10 preferably includes the electronic configuration generally illustrated in FIG. 2, which has: a processor 38; a memory device 40 for storing program code or other data; a video monitor 32 or other display device (i.e., a liquid crystal display); a plurality of speakers 34; and at least one input device as indicated by block 33. The processor 38 is preferably a microprocessor or microcontroller-based platform which is capable of displaying images, symbols and other indicia such as images of people, characters, places, things and faces of cards. The memory device 40 can include random access memory (RAM) 42 for storing event data or other data generated or used during a particular game. The memory device 40 can also include read only memory (ROM) 44 for storing program code which controls the gaming device 10 so that it plays a particular game in accordance with applicable game rules and pay tables.

As illustrated in FIG. 2, the player preferably uses the input devices 33, such as the arm 18, play button 20, the bet one button 24 and the cash out button 26 to input signals into gaming device 10. Furthermore, it is preferable that touch screen 46 and an associated touch screen controller 48 are used instead of a conventional video monitor 32. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hardwired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. For purposes of describing the invention, the controller includes the processor 38 and memory device 40.

With reference to FIGS. 1 and 2, to operate the gaming device 10, the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on the display window 28. The gaming device 10 also includes a display device such as a video monitor 32 shown in FIG. 1 enabling the player to play the bonus round. Preferably, the qualifying condition is a predetermined combination of indicia appearing on a plurality of reels 30. As illustrated in the three reel slot game shown in FIG. 1, the qualifying condition could be the text "BONUS!" appearing in the same location on three adjacent reels.

Figure 3A:
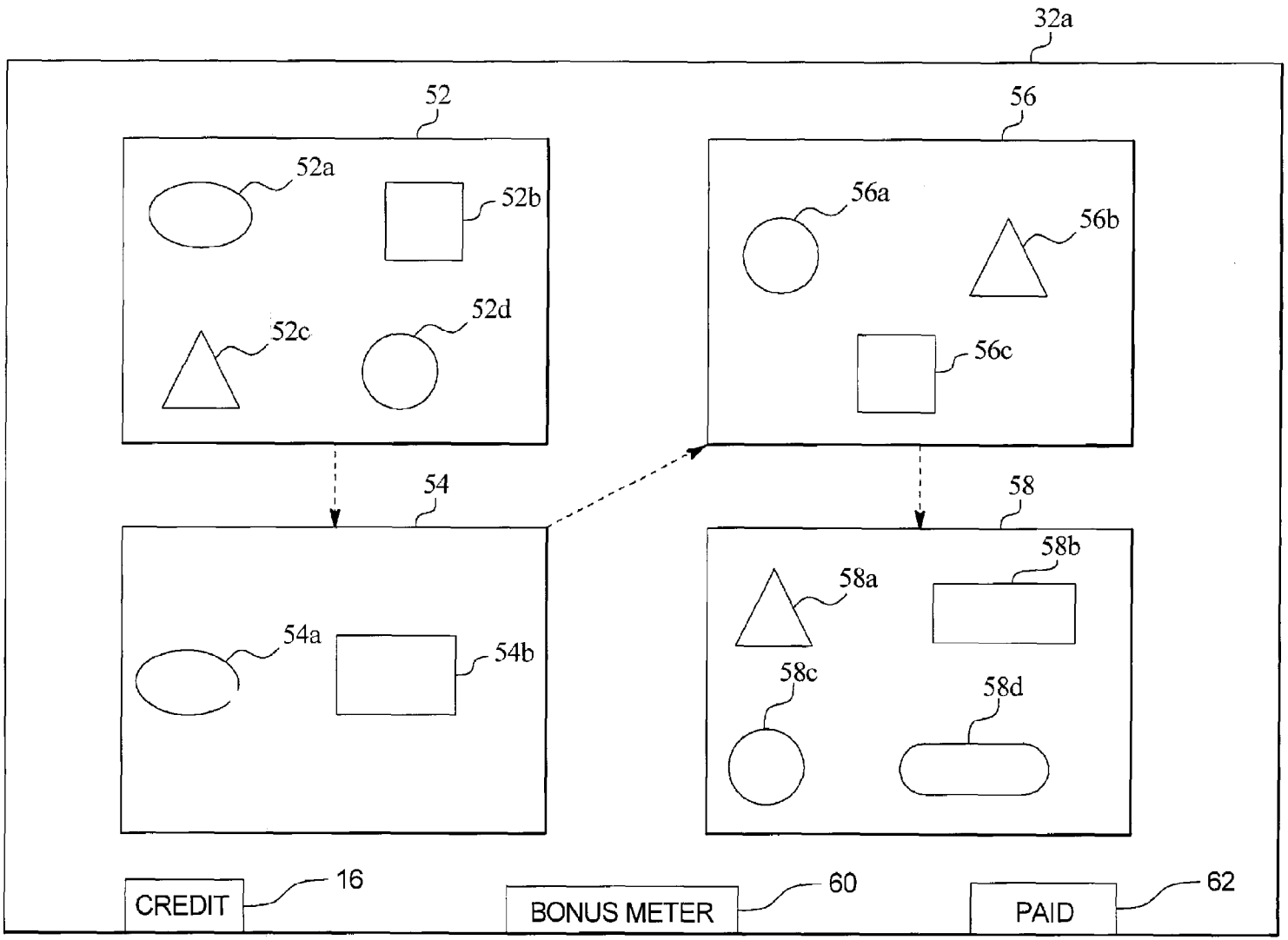
FIG. 3A is a plan view of a screen having multiple selection groups.

Referring to FIG. 3A, the present invention provides a bonus round which includes a plurality of selection groups displayed by a video monitor 32. The example in FIG. 3A includes four separate groups 52, 54, 56 and 58, which are suitably marked so that a player may easily distinguish one group from another. Alternatively, as discussed below, an audio production can define the groups. The present invention can provide any number of groups and is not limited to the four groups shown in screen 32*a*.

Groups 52, 54, 56, and 58 each contain a plurality of selections. Group 52 contains four selections, 52*a* through 52*d*. Each selection preferably contains different indicia or symbols, although two or more selections in a group or in a screen can contain the same indicia or symbols. For purposes of illustration, the indicia are shown generally as shapes, i.e., an oval, a rectangle, a diamond, and a circle. The present invention can employ any suitable indicia or symbols that preferably correspond to a bonus round theme as described below.

Group 54 has two selections, 54*a* and 54*b*, group 56 has three selections, 56*a*, 56*b* and 56*c* and group 58 has four selections 58*a*, 58*b*, 58*c* and 58*d*. The present invention can provide any number of selections in each group, preferably in accordance with the game theme, and is not limited to the number of selections shown in any of the groups in FIG. 3. Each group preferably contains more than one selection, and two or more groups can have the same number of selections.

Figure 3B:
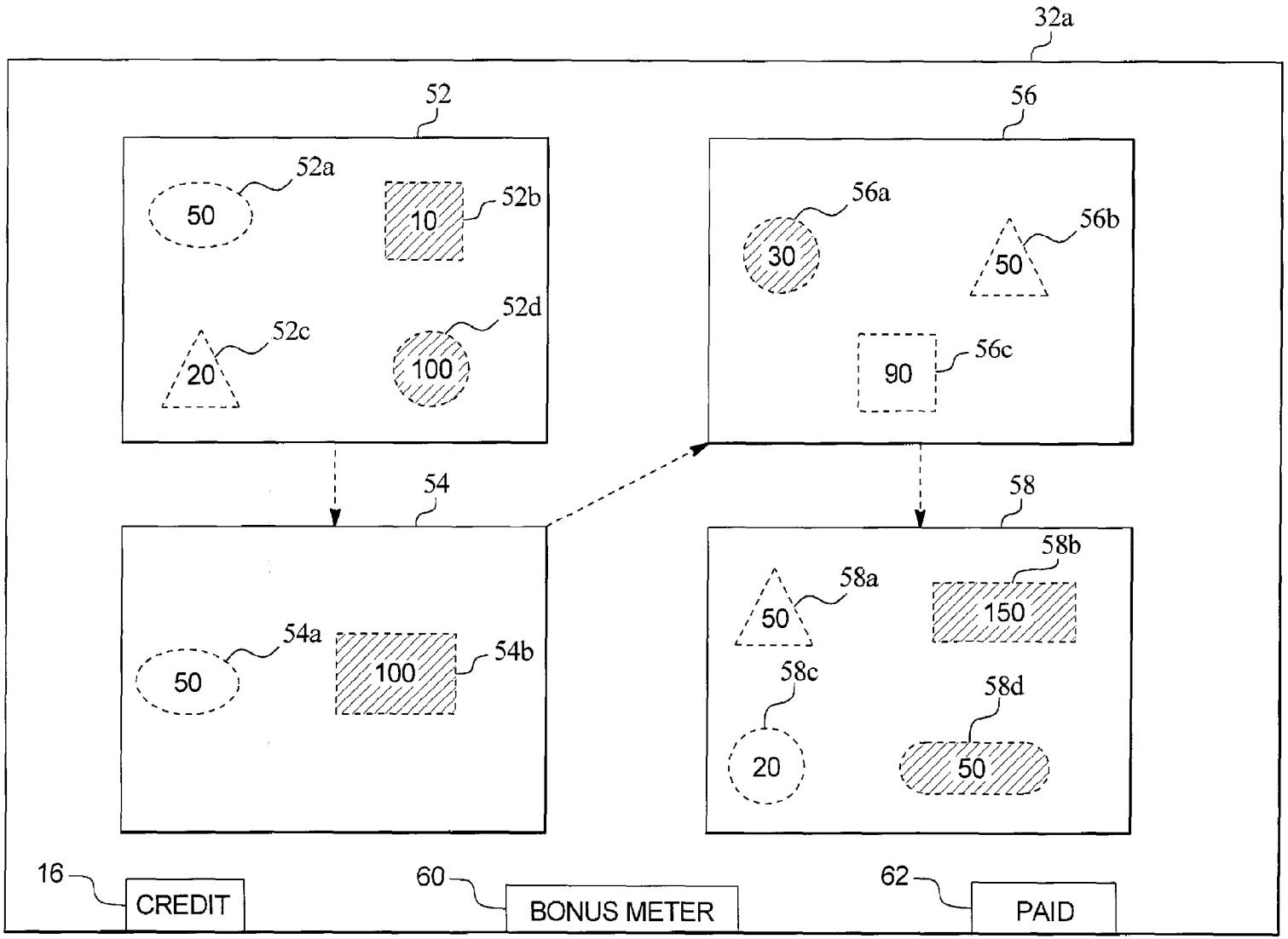
FIG. 3B is a plan view of the screen in FIG. 3A, wherein the player has selected from each selection group.

Referring to FIG. 3B, the present invention reveals the awards, which the player either selected or not, at the end of the round as shown and displays them in the same screen 32*a*. The groups 52, 54, 56 and 58 are shown as they would appear after a player has played or picked from all the selections from the round. That is, the group originally contained the selections as shown in the screen 32*a* of FIG. 3A. After the player picked the selections of each of the groups 52 through 58, the game unmasked or revealed the underlying awards by removing the masking indicia. Alternatively, the game can unmask or reveal the underlying awards after the player selects from a group.

The awards are preferably a number of credits, although the awards can alternatively be multipliers. The present invention contemplates awarding the player gaming device credits or multipliers. The bonus meter 60 displays the tallied multipliers or credits for the round. The paid display 62 shows that part of the bonus meter 60 that the game has credited to the credit meter 16. When the award is a multiplier, the bonus meter 60 updates or accumulates the multipliers, the credit meter 16 updates the player's total credits as the game downloads them and the paid display 62 shows the number of credits downloaded to the credit display.

Screen 32*a* also displays the credit meter 16 described above that can be in place of or in addition to the credit meter 16 displayed in FIG. 1. The credit meter 16 continuously updates the player's total gaming device credits regardless of the manner in which the game awards the player during the bonus round.

PREFERRED EMBODIMENT

Figure 4A:
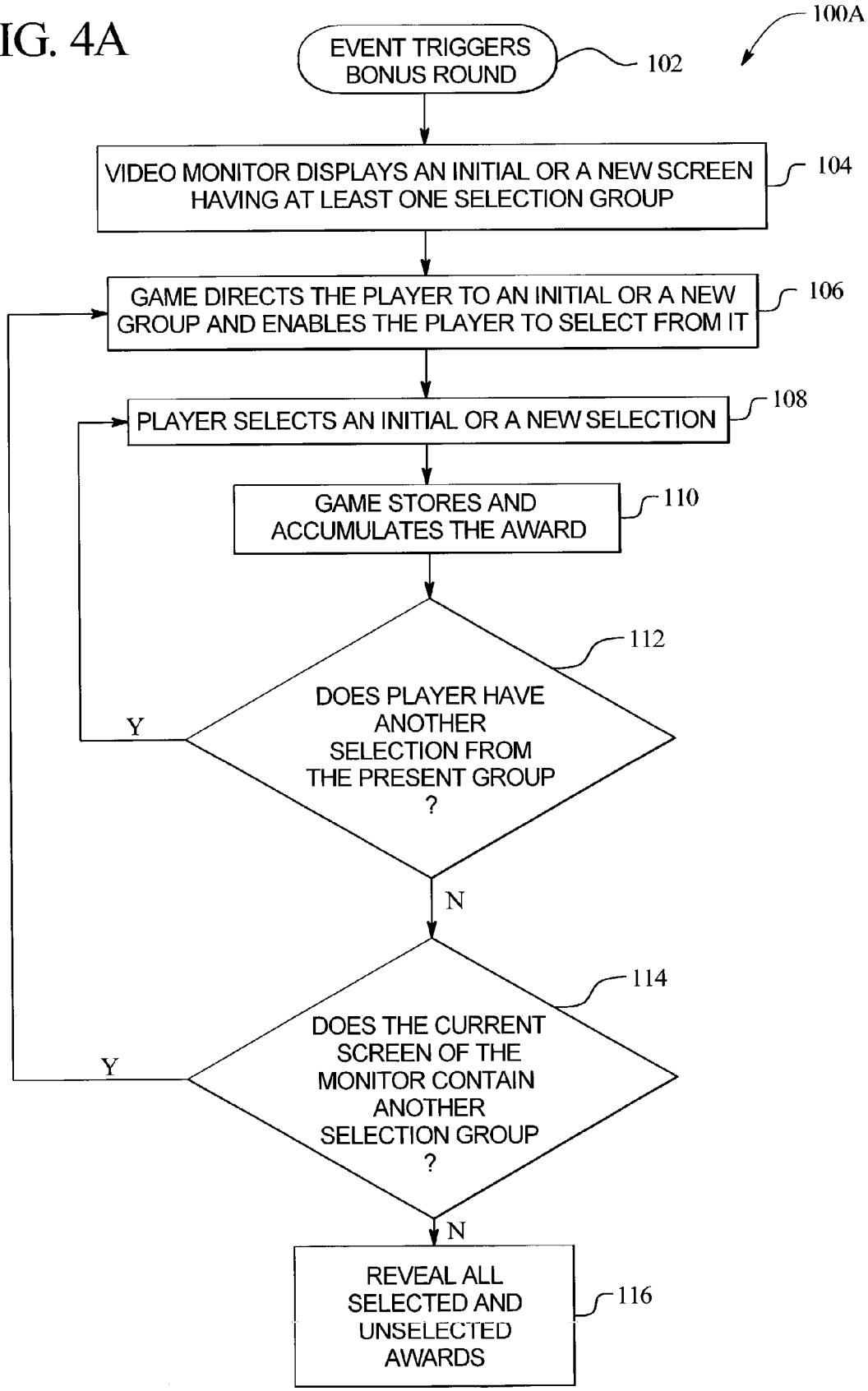
FIG. 4A is a flow diagram of the preferred embodiment of the present invention.

Referring now also to FIG. 4A, a preferred embodiment of the present invention, generally indicated by the number 100*a*, enables the player to pick from a particular group until the player picks a predetermined number of selections for that group, after which the game preferably enables the player to pick from another group. The present embodiment performs the following sequence of operation upon one of the bonus round triggering events described above, as indicated by oval 102.

Upon a bonus round triggering event, the video monitor 32 displays a new screen such as screen 32*a* having a plurality of groups such as groups 52 through 58, as indicated by block 104. The game directs the player to an initial or new group and enables the player to pick from that group as indicated by block 106.

The game can direct the player to an initial or a new group in a plurality of different ways. The game upon the bonus round triggering event preferably produces an audio instruction from the speakers 34 that leads and directs the player from group to group in accordance with a predetermined program stored in the controller. The game also preferably displays a suitable visual marker that leads and directs the player to the currently enabled group. For example, the game can visually highlight the enabled group with respect to the non-enabled or disabled groups or provide suitable indicia on the disabled groups that indicates their dormancy or disablement. Preferably, the gaming device does not allow a player to pick a non-enabled selection and provides a suitable message or display that directs the player to the enabled group.

After directing the player to the enabled group and prompting the player to pick a selection such as 52*a* through 52*d* of the group 52, the player picks an initial or a new selection as indicated by block 108. The present invention preferably provides a touch screen 46 and a touch screen controller 48 (FIG. 2), in which case the game enables the player to simply touch a selection to pick it. That is, to pick the oval 52*a* of the group 52, the player simply touches the oval. Likewise, to pick the triangle 56*b* of the group 56, the player simply touches the triangle.

The present invention can alternatively provide an additional input device 33 (FIG. 2) or a plurality of such devices in conjunction with a non-touch screen video monitor 32. This embodiment is preferred when the gaming device is a pub-style game, wherein the players employ remote hand-held input devices while sitting or standing some distance away from the monitor. It should be appreciated that the gaming device of FIG. 1 can also have separate inputs that enable the player to pick one of the selections. For example, a joystick mounted to gaming device 10 can enable the player to position a cursor on the desired selection, whereupon a separate "pick-it" button or a suitable alternative enables the player to pick the same.

After the player picks an initial or a new selection as indicated by block 108, the game stores and accumulates or escrows the award of the picked selection, as indicated by block 110, and can provide a suitable audio message congratulating the player, etc. Alternatively, the gaming device unmasks or removes the indicia identifying the chosen selection and reveals an associated award and accumulates the award in the appropriate displays 60, 62, and 16.

For example, referring to FIG. 3B, the game preferably reveals the awards and updates the appropriate meters at the end of the bonus round, i.e., after the player has made all of the picks or choices from all of the selection groups displayed in screen 32*a*. In an alternative embodiment, when the player picks the selection associated with an award, the game removes the indicia of the selection, reveals the award and adds the credits to the bonus meter 60 and ultimately to the credit display 16, wherein the paid display 62 shows the number of credits that are downloaded to the credit display. If the game awards multipliers (not shown), when the player picks a selection, the game alternatively reveals and displays the multiplier award, adds the multiplier to the bonus meter 60, downloads a number of credits to the credit display 16 equal to the multiplier award times the player's bet and displays the downloaded number of credits in the paid display 62.

Referring again to FIG. 4A, after the player picks a selection, the controller of the gaming device makes a number of determinations based upon the predetermined number,of picks in any given group and the number of groups in any given screen. After the player picks a selection, the game first determines whether the game enables the player to have another pick from the current group as indicated by diamond 112.

Referring also to the groups 52, 54 56 and 58 of FIG. 3A, the game preferably enables a player to have a number of picks which is less than the total number of selections. For example, the game can enable the player to choose 3 of the 4 shapes from the group 52, 1 of the 2 shapes from the group 54, and 2 of the 3 shapes from the group 56 and 2 of the 4 shapes from the group 58. The present invention could alternatively enable the player to choose all or none of the selections in a group, but preferably, the game enables the player to choose at least one but less than all the selections from any given group.

Referring again to diamond 112, if the game enables the player to pick another selection from the current group, then the player does so as indicated by block 108. The player picks from a group until there are no more picks, at which point the game makes a second determination as indicated by diamond 114. As also indicated by diamond 114, the game then determines whether another group exists. If so, the game directs the player to a new group and enables the player to pick from it as indicated by block 106. As described above, the game produces suitable audio and visual displays that direct the player to the new group.

When there are no more groups from which a player may choose as indicated by diamond 114, the game preferably reveals the awards associated with all the picks that a player has made from the video monitor 32. This point is preferably the end of the bonus round or, alternatively, a transitional point in a multiple screen round as discussed below. Either way, the game unmasks and reveals each of the picked selections and shows the player the award for each. As shown in FIG. 3B, the game preferably reveals the awards in the spot where the selection resided. The game also shows a tallied award in the bonus meter 60, a number of credits downloaded to the credit display 16 in the paid display 62 and the player's overall credits in the credit display 16.

Alternatively, the game can display the awards on a group by group basis, wherein the game reveals selected and unselected awards, as indicated in block 116, before looking for another selection group as indicated by diamond 114. In this embodiment, the game displays the awards when the player finishes picking from a group. After displaying the awards, the game determines whether another group exists as indicated by diamond 114.

Referring to FIG. 3B, the groups each contain award displays which display the awards with phantom indicia indicating the indicia's disappearance as well as a cross-hatched awards. The cross hatching indicates that during the operation of the game, the player did not pick the cross hatched awards; rather, the game unmasked or revealed the awards at the end of the round. To enhance player excitement and enjoyment, the bonus round can show or reveal to the player what the player could have chosen, i.e., the lost opportunities. It should be appreciated that the present invention does not require that the game reveal selections not picked by a player. Further, the game can reveal the selections not picked by a player in any suitable manner and is not limited to the indicia with cross hatching as shown.

Referring to FIG. 4A, the game can reveal selections not picked by a player at two different points in the sequence of operation of the present invention. Preferably, the game reveals the selections not picked by a player for all the groups, as indicated by FIG. 4A, after the game determines that the current screen of the bonus round contains no other groups, i.e., when the game also reveals the awards. Alternatively, the game can display the selections not picked by a player from a particular group, after the game determines that the particular group has no more picks (not shown). In both embodiments, the game preferably maintains the revealed awards until the bonus round ends. Alternatively, the game could maintain the revealed awards for a predetermined time.

Referring to FIG. 4B, an alternative embodiment of the present invention generally indicated by the number 100b contains multiple screens. The multiple screen embodiment is the same as the preferred embodiment until after the game reveals the selected and unselected awards as indicated by block 116. Referring to diamond 118, of FIG. 4B, the game makes a third determination, i.e., whether the bonus round contains another screen. If so, the video monitor 32 displays a new screen having at least one group as indicated by block 104, and the game repeats the entire sequence just described. When the game provides only a single screen or the player has played all the screens of the round, the game terminates the bonus round and returns the player to the base game operation of the gaming device. It should be appreciated that the multiple screen embodiment of the bonus round of the present invention can employ any number of screens, each of which can contain any number of groups, and each of which can contain any number of selections and any number of picks less than or equal to the number of selections.

Referring to FIGS. 5A through 5D, the multiple screen embodiment of the present invention is illustrated. In this example, each screen of the monitor 32 has one group. The multiple screen embodiment can alternatively have more than one group in each screen. For purposes of illustration, the player enters the bonus round upon a bonus round triggering event having 10 gaming device credits as shown by the credit display 16 of FIG. 1. The illustration also employs the cross-hatched indicia to display the unselected selections as used in FIG. 3B. It should be appreciated that the game can reveal selections not picked by the player in any suitable manner.

Figures 5A, 5B, 5C, 5D:
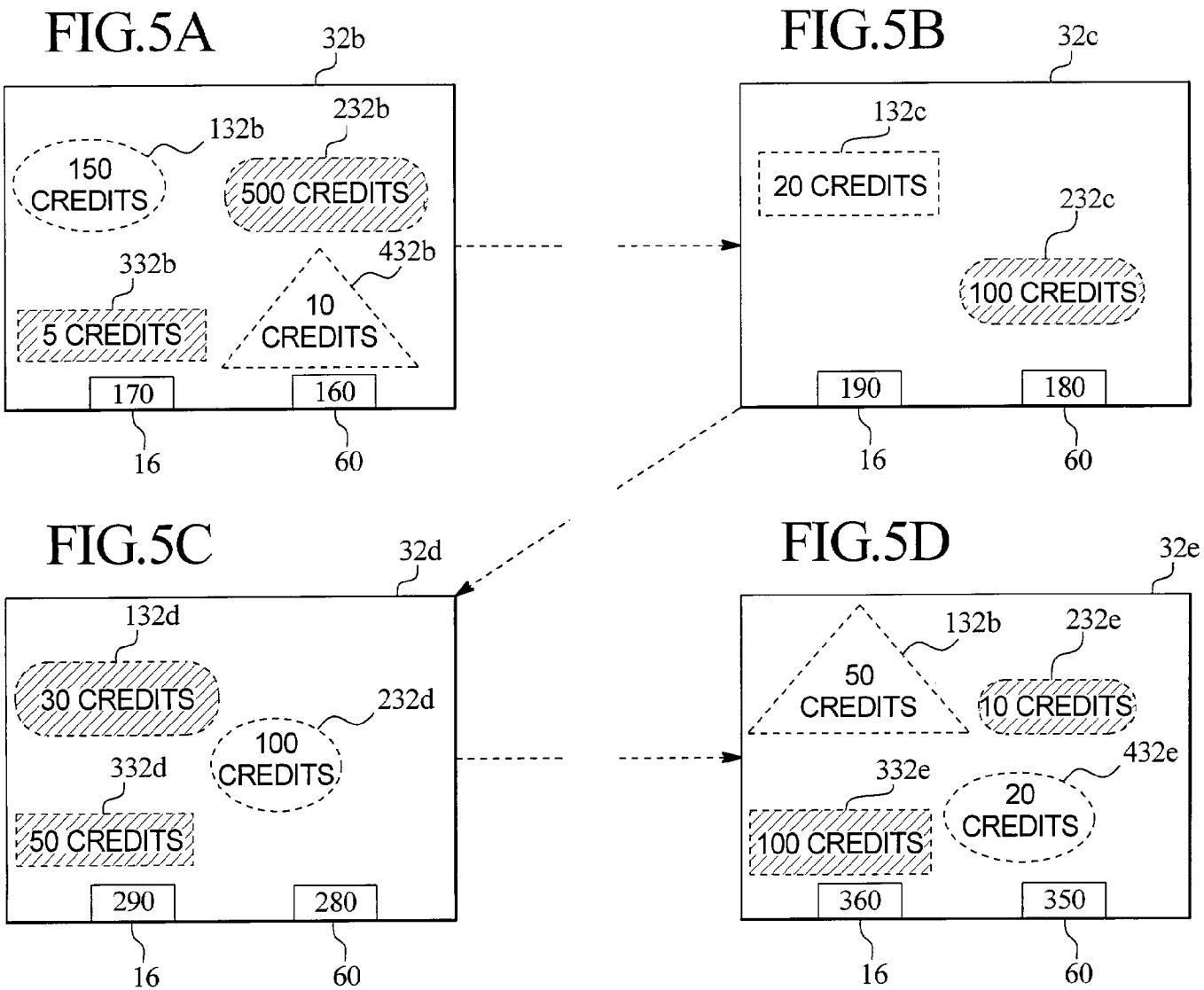
FIGS. 5A, 5B, 5C and 5D are illustrations of screens wherein each screen displays a separate selection group.

The present invention first displays the screen 32*b* of FIG. 5A having four selections 132*b*, 232*b*, 332*b* and 432*b*, a credit display 16 and a bonus meter 60. The game provides the player with two picks from the screen 32*b*, and the player picks selections 132*b* and 432*b*. After the player picks the two selections, the game displays the awards for the unselected selections 232*b* and 332*b* and the game awards the player 160 credits and updates the meters. Since the screen contains only one selection group, the player obtains and views the award after the two picks.

The game then displays a second screen 32*c* of FIG. 5B having two selections 132*c* and 232*c*. The game provides the player with one choice, with which the player picks the selection 132*c*. The game reveals its award, updates the displays and reveals the selection not picked by the player, 232*c*. The game proceeds in this manner to display the third screen 32*d* of FIG. 5C, in which the player picks one of the three selections 132*d*, 232*d* and 332*d*. The game displays a final screen 32*e* of FIG. 5D, in which the player picks two of the four selections 132*e*, 232*e*, 332*e* and 432*e*. At the end of bonus round, as illustrated in the screen 32*e* of FIG. 5D, the game has displayed four separate screens on video monitor 32, and the player has amassed 350 credits from the round as shown by the bonus meter 60.

ALTERNATIVE EMBODIMENT

Figure 6:
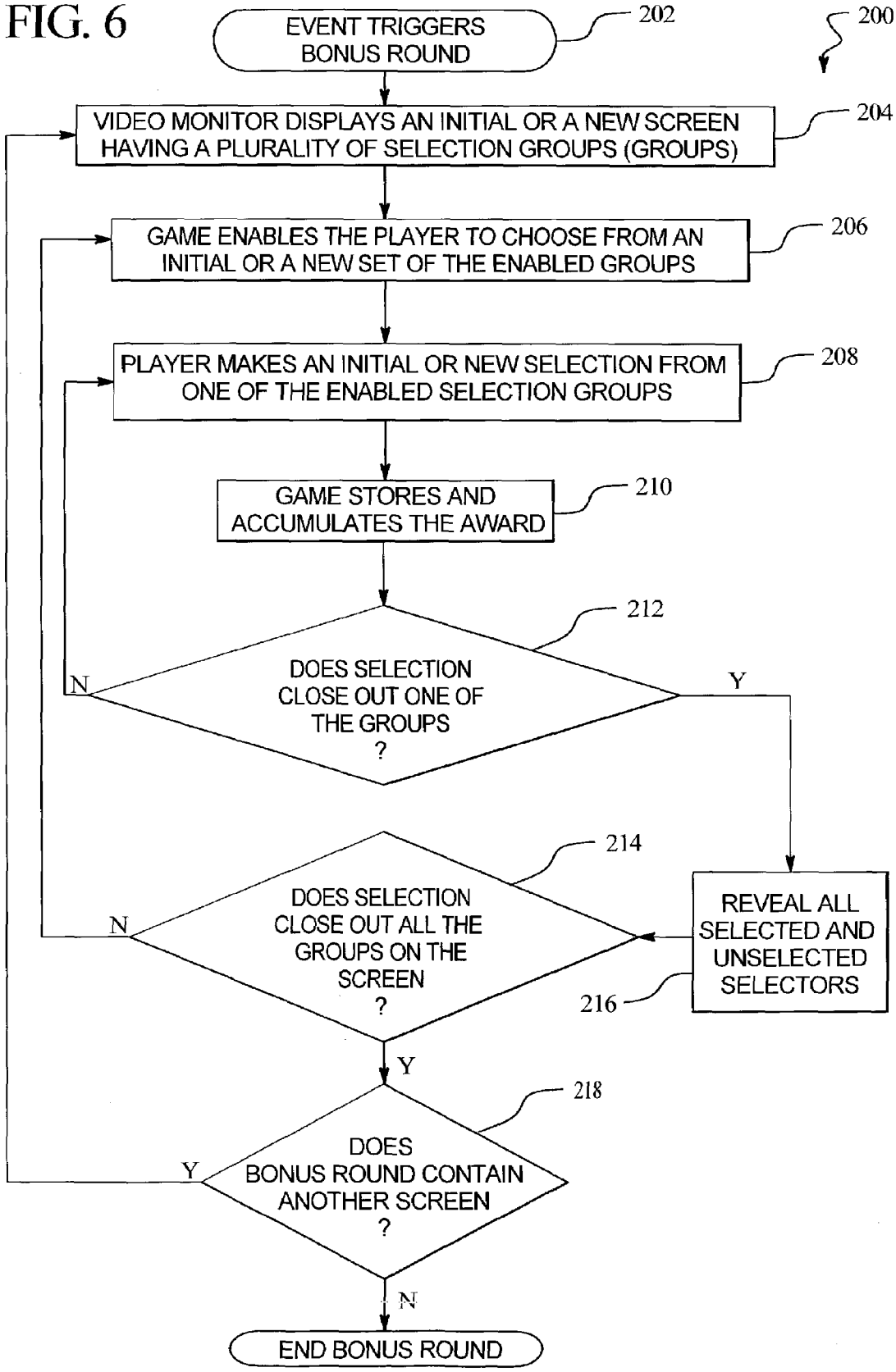
FIG. 6 is a flow diagram of an alternative embodiment of the present invention.

Referring to FIG. 6, an alternative embodiment of the present invention generally indicated by the number 200 enables the player to pick from any group in a plurality of groups until the player picks a predetermined number of selections from each group. The alternative embodiment can employ a single screen or multiple screens as described above. For the ease of illustration, the example following the description is described in conjunction with a single screen.

Referring to oval 202 of FIG. 6, upon a bonus round triggering event, the video monitor 32 displays an initial or a new screen preferably having a plurality of groups as indicated by block 204. The main difference between this embodiment and the preferred embodiment is indicated by block 206, wherein the game enables the player to pick from any of the groups, intermittently or otherwise, as opposed to directing a player to a particular group and only enabling the player to pick from that group. That is, referring to FIG. 3A, the player can pick once from group 52, twice from group 56, once from group 54, or any combination thereof, and is not limited by the boundaries defining the groups.

Referring to block 208 of FIG. 6, the player picks a selection from any one of the enabled groups. The game stores the award for the pick and accumulates the award as indicated by block 210. Alternatively, the game also displays the award and updates the appropriate displays 16, 60 and/or 62 as indicated by block 210. This embodiment of the present invention then performs a number of determinations. First, it determines whether the previous pick closed out or disabled the group from which the player previously selected as indicated by diamond 212. If not, the player can make a new pick from any of the previously enabled groups as indicated by block 208.

If the previous pick closes out one of the groups, the game in the this embodiment preferably reveals all the picked awards and unselected awards for the group as indicated by block 216 so that the player will not choose from this group again. Thereafter, this embodiment makes a second determination, indicated by diamond 214, wherein the game determines whether the previous pick also closed out all the groups of the current screen displayed by the video monitor 32. If not, then the game closes out the appropriate group and re-enables the player to pick from the remaining groups as indicated by block 206.

When the player attempts to pick from a closed out group, the game preferably provides a suitable audio and/or visual display informing the player to pick from another group. The audio and visual displays preferably correspond to the bonus round theme. As can be seen, in this embodiment, the game does not direct a player to a particular group, rather, it follows or tracks the player's picks and steers the player away from dormant or disabled groups. Additionally, the alternative embodiment preferably reveals the awards and selections not selected by the player as soon as a group becomes disabled to visually indicate that the group is spent.

Referring to diamond 214 of FIG. 6, when the player makes the final pick from the final group of the screen, the game reveals the final group and displays the total amount for the screen or round. The game in the alternative embodiment can have multiple screens. If so, this embodiment makes a third determination, indicated by diamond 218, wherein the game determines whether the bonus round contains another screen. If so, the game repeats the above described sequence until the bonus round contains no more screens. If not, the bonus round terminates and the player returns to the base game.

Referring still to FIG. 6, as in the preferred embodiment, the game preferably reveals the selections not selected by the player to the player. The game can reveal the selections not selected by the player at two different points in the sequence of operation of the alternative embodiment of the present invention. First, the game can display the selections not selected by the player for a particular group, as illustrated in FIG. 6, after the game determines that the previous pick closed out or disabled the particular group. As discussed above, this alternative is preferred so that the player does not choose from a disabled group.

Alternatively, the game can display the selections not selected by the player for all the groups after the game determines that the previous pick closed out or disabled all the groups of the current screen (not shown). Either way, the game preferably maintains the revealed selections until the bonus round changes screens or ends. Alternatively, the game could maintain the displays for a predetermined time.

Figure 7:
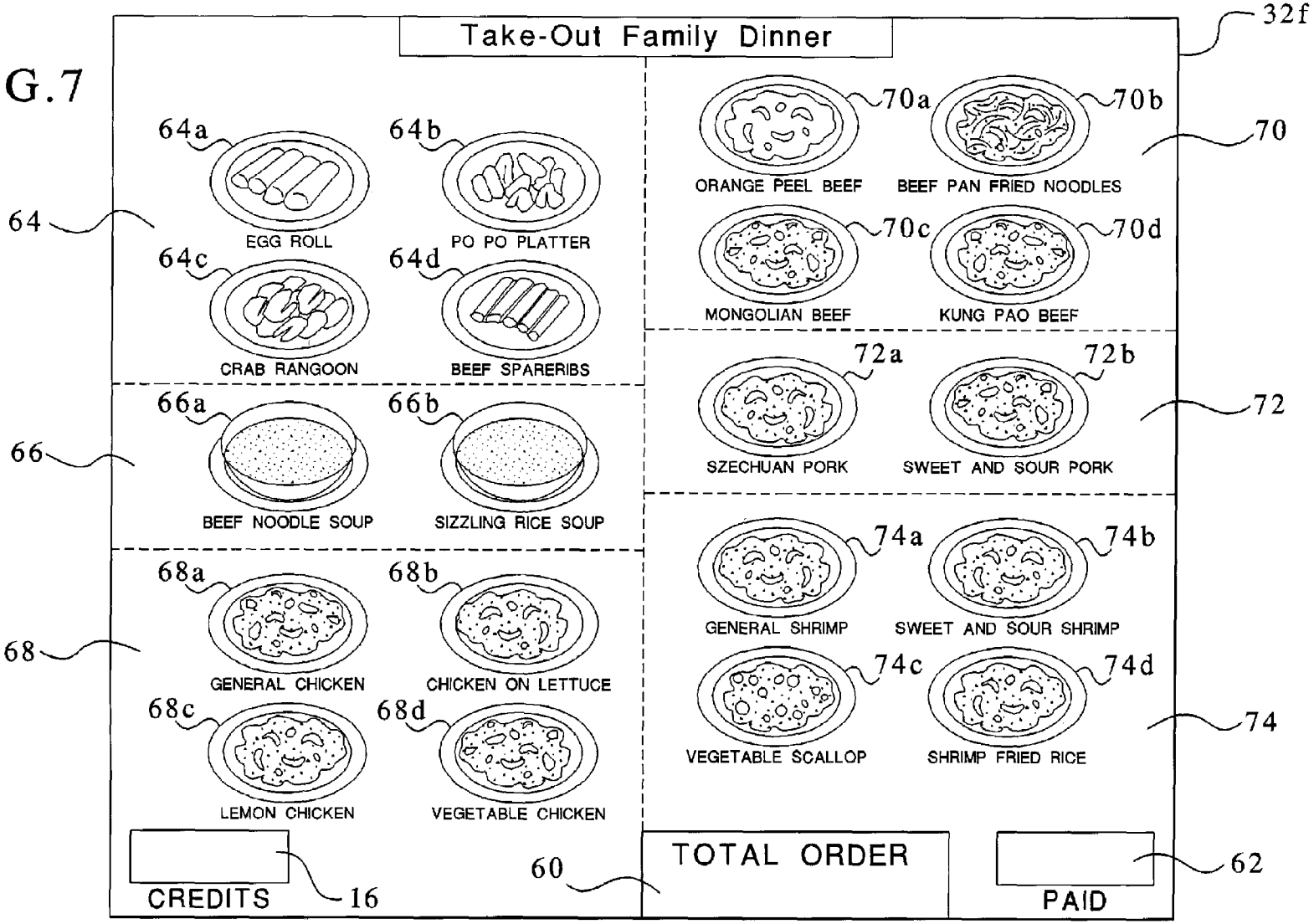
FIG. 7 is an enlarged front plan view of a screen of one embodiment of the present invention, wherein the selection groups correspond to a theme.

Referring to FIG. 7, one preferred embodiment of the present invention provides all of the selection groups in a single screen 32*f*, which is focused on a particular theme. The theme is ordering a take-out oriental meal for the entire family, wherein the symbols are different items that one can order from an oriental restaurant. Each dish costs a certain "price," which is the award. The bonus meter 60 displays the accumulated "total order" price and the paid display 62 displays a number of game credits transferred to the credit meter 16. The credit display 16 displays the player's total updated gaming device credits.

The single screen 32*f* contains six selection groups 64, 66, 68, 70, 72 and 74. The groups are defined by a food type or group, i.e., appetizers, soups, chicken dishes, beef dishes, pork dishes and seafood dishes, respectfully. The dashed lines separating the groups are for purposes of illustrating this example and do not form part of the invention or its illustration. The present invention preferably separates and defines the groups using an audio display that guides, directs or follows the player through the bonus round.

In the preferred embodiment, upon a bonus round triggering event, the screen 32*f* appears and a voice directs the player to choose a number of appetizers from the selections 64*a* through 64*d* of the appetizer group 64. The voice can initially say for example, "choose two appetizers," or the voice can say, "good choice, now choose another appetizer" after the player makes an initial pick. The game then directs the player to choose a number of soups from the selections 66*a* or 66*b*, then to choose a number of chicken dishes 68*a* through 68*d*, then to choose a number of beef dishes from the selections 70*a* through 70*d*, then to choose a number of pork dishes from the selections 72*a* and 72*b* and finally to choose a number of seafood dishes from the selections 74*a* through 74*d*. The game preferably displays the picked awards and the unselected awards after the player picks from the final seafood group 74. Alternatively, when each of the food groups becomes spent, the game displays the awards of the picked and unselected selections for that group. In addition to the voice, this embodiment of the game displays a video of a person taking the order and asking the questions or directing the players.

In an alternative embodiment, upon a bonus round triggering event, the screen 32*f* appears and a voice says for example, "Can I have your order of any of the wonderful dishes displayed before you." When the player attempts to pick from a disabled food group, the voice produces a suitable message such as, "We are out of chicken, please make another selection from the remaining wonderful dishes displayed before you." The player proceeds to pick selections from each food group until no picks remain. In this embodiment, the game preferably displays the awards of the picked and unselected selections as soon as the groups become spent to remind the player not to pick from the spent group. Alternatively, the game can do so after the player picks from the final remaining enabled group.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

a wagering game operable upon a wager by a player;

a secondary game operable upon an occurrence of a triggering event in the wagering game;

a plurality of selection groups in the secondary game;

a plurality of selections in each of said selection groups;

a guaranteed number of picks associated with each selection group, wherein each guaranteed number of picks includes at least one pick, and wherein said guaranteed number of picks of at least one of the selection groups is less than said number of selections in said selection group;

a plurality of awards, each of said plurality of awards having a value greater than zero, wherein each said award is individually associated with at least one of the selections, and wherein each selection has one of said awards individually associated with said selection;

a display device;

an input device; and a processor programmed to operate with the display device and the input device, for each play of the secondary game, to sequentially display each of the selection groups to the player in said play of the secondary game, and when each of the selection groups is being displayed in said play of the secondary game:

(a) simultaneously display to the player each of the selections in said selection group, (b) enable the player to make the associated guaranteed number of picks of the selections in said selection group, without regard to any of the selections picked in any of the other selection groups, (c) evaluate each of the picked selections to determine the award associated with each of the picked selections, and (d) display and provide to the player the determined awards, wherein the player is provided a number of determined awards which is at least equal to the number of selections picked in said selection group.

2. The gaming device of claim 1, wherein said guaranteed number of picks of the selections from each selection group is predetermined.

3. The gaming device of claim 1, wherein the player is enabled to pick from each displayed selection group in a sequence related to the progress of the player through the secondary game.

4. The gaming device of claim 1, wherein the processor designates the selection group from which the player is enabled to pick.

5. The gaming device of claim 4, wherein the selection group from which the player is enabled to pick is designated by audio instruction.

6. The gaming device of claim 4, wherein the player is enabled to pick less than the number of picks provided to the player for the designated group before being enabled to pick from another of said selection groups.

7. The gaming device of claim 1, wherein the awards associated with each of the selections picked by the player are accumulated before revealing an accumulated award to the player.

8. The gaming device of claim 1, wherein the awards associated with each of the selections picked by the player in each group of selections are accumulated before revealing an accumulated award to the player for said group.

9. The gaming device of claim 8, wherein revealing the accumulated award to the player for said group disenables the player from picking from said group.

10. The gaming device of claim 1, wherein at least one of the selection groups includes a different number of selections.

11. The gaming device of claim 10, wherein the guaranteed number of picks for each selection group is related to the number of selections in each of said selection group.

12. The gaming device of claim 1, wherein the guaranteed number of picks for each of the selection groups is the same.

13. The gaming device of claim 1, wherein each of the plurality of selection groups is simultaneously displayed.

14. The gaming device of claim 1, wherein each award is individually associated with one of the selections.

15. A method for operating a gaming device including a wagering game, said method comprising:

(a) upon a triggering event in the wagering game, sequentially displaying to a player a plurality of selection groups of a secondary game, each selection group including a plurality of simultaneously displayed selections;

(b) randomly associating a plurality of awards with the selections, each of said plurality of awards having a value greater than zero, wherein each said award is individually associated with at least one of the selections, and wherein each said selection has one of said awards individually associated with said selection;

(c) associating a guaranteed number of picks with each selection group, wherein each said guaranteed number of picks includes at least one pick, and wherein the number of picks for at least one of the selection groups is less than the number of selections in said selection group;

(d) when each selection group is being displayed to the player, enabling the player to make the associated guaranteed number of picks of the selections from said selection group without regard to the selections picked in any other of the selection groups;

(e) evaluating each of the selections picked in each of said selection groups to determine the award associated with each of the picked selections; and (f) displaying and providing to said player the determined awards, wherein the player is provided a number of determined awards which is at least equal to the number of selections picked by the player.

16. The method of claim 15, which is provided to the player through a data network.

17. The method of claim 16, wherein the data network includes an internet.

18. The method of claim 15, wherein instructions for a processor to implement said method are stored on a data storage device.

19. The method of claim 15, wherein displaying the plurality of selection groups includes simultaneously displaying two or more of said plurality of selection groups.

20. A gaming device comprising:

a processor;

a primary game operable upon a wager;

a secondary game operable upon a triggering event in the primary game;

a display device controlled by the processor;

a plurality of selection groups of the secondary game adapted to be sequentially displayed by the display device, each selection group including a plurality of selections simultaneously displayed by the display device upon display of said selection group;

an award having a value greater than zero individually associated with each selection in each selection group, wherein the plurality of awards associated with the selections in each group are initially masked from a player;

a guaranteed number of picks of the selections of each selection group in the secondary game, wherein the guaranteed number of picks for each selection group is at least one, and the number of picks for at least one of the selection groups is less than the number of selections in said group; and an input device for enabling the player, when each of said plurality of selection groups is being displayed in the secondary game, to make the guaranteed number of picks of the selections associated with said selection group without regard to any selections made in any of the other selection groups, wherein the player obtains a number of the awards individually associated with each of the picked selections, said number of obtained awards being at least equal to the number of selections picked in the selection groups.

21. The gaming device of claim 20, wherein the number of picks from each selection group is predetermined.

22. The gaming device of claim 20, wherein two or more of said plurality of selection groups are simultaneously displayed.

23. A gaming device comprising:

a processor;

a primary game operable upon a wager;

a secondary game operable upon a triggering event in the primary game;

a display device controlled by the processor;

an input device controlled by the processor;

a plurality of selection groups of the secondary game adapted to be sequentially displayed by the display device, each selection group including a plurality of selections simultaneously displayed by the display device upon display of said selection group;

a guaranteed number of picks for each selection group in the secondary game, wherein the processor and input device operate to enable a player to make at least one pick from each selection group when that selection group is being displayed, without regard to any of the selections picked in any of the other selection groups;

a plurality of awards, each of said plurality of awards having a value greater than zero, wherein each award is individually associated with at least one of the selections in the selection groups, and wherein each said selection includes one of said awards individually associated with said selection;

a total award provided to the player that is based on an accumulation of the awards associated with each of the selections picked by the player; and a reveal sequence that shows awards associated with at least one of any selection from each group that is not picked by the player.

24. The gaming device of claim 23, wherein the reveal sequence displays the awards associated with each selection from each group that is not picked by the player.

25. The gaming device of claim 23, wherein the number of picks for each selection group is less than the number of selections in said group.

26. The gaming device of claim 23, wherein each award is individually associated with one of the selections.

27. The gaming device of claim 23, wherein two or more of said plurality of selection groups are simultaneously displayed.

28. A gaming device comprising:

a wagering game operable upon a wager by a player;

a secondary game operable upon a triggering event in the wagering game;

a plurality of selection groups in the secondary game;

a plurality of selections in each of said selection groups;

a plurality of awards, each of said plurality of awards having a value greater than zero, wherein each said award is individually associated with at least one of the selections, and wherein each selection includes one of said awards individually associated with said selection;

a display device;

an input device; and a processor programmed to control the secondary game and operable with the display device and input device for each play of the secondary game to:

(a) sequentially display said selection groups of the secondary game and simultaneously display the selections in each of the displayed selection groups upon display of each of said selection groups, (b) enable the player to sequentially make a guaranteed number of picks of the selections in each of the selection groups without regard to any of the selections picked in any of the other selection groups, wherein said guaranteed number of picks of the selections in each of the selection groups includes at least one pick, and wherein said guaranteed number of picks for at least one of the selection groups is less than said number of selections in said selection group, (c) evaluate each of the selections picked in each of the selection groups to determine the award associated with each of the selections picked by the player, and (d) display and provide to the player the determined awards, wherein the player is provided a number of determined awards which is at least equal to the number of selections picked by the player.

29. The gaming device of claim 28, wherein said guaranteed number of picks of the selections from each selection group is predetermined.

30. The gaming device of claim 28, wherein the processor is operable with the display device and input device to sequentially display said selection groups and simultaneously display the selections in each of said selection groups of the secondary game.

31. A method of operating a gaming device having a primary game operable upon a wager, said method comprising:

(a) randomly and individually associating a plurality of awards with a plurality of selections in a plurality of selection groups adapted to be sequentially displayed to a player in a secondary game operable upon a triggering event in the primary game, wherein each of said plurality of awards has a value greater than zero, and wherein each of said awards is individually associated with at least one of the selections, and each of the selections has one of said awards individually associated with said selection;

(b) displaying one of said selection groups to the player including simultaneously displaying the plurality of selections in said selection group to the player;

(c) enabling the player to pick at least one but less than all of the selections from the currently displayed selection group;

(d) regardless of the selections picked from the currently displayed selection group, repeating steps (b) and (c) for each of the other selection groups in said plurality of selection groups until each of the selection groups have been displayed to the player and the player has picked at least one but less than all of the selections from each of said other selection groups;

(e) evaluating each of the selections picked in said selection groups to determine the award associated with each of the selections picked from said selection groups; and (f) providing to the player the determined awards, wherein the player is provided a number of determined awards which is at least equal to the number of selections picked by the player from the selection groups.

32. The method of claim 31, which includes providing an audio comment upon a pick from one of the selection groups.

33. The method of claim 31, which is controlled through a data network.

34. The method of claim 33, wherein the data network includes an internet.

35. The method of claim 31, wherein instructions for a processor to implement steps said method are stored on a data storage device.

36. A gaming device comprising:

a wagering game operable upon a wager by a player;

a secondary game operable upon an occurrence of a triggering event in the wagering game;

a plurality of selection groups in the secondary game;

a plurality of selections in each of said selection groups;

a guaranteed number of picks associated with each selection group, wherein each guaranteed number of picks includes at least one pick, and wherein said guaranteed number of picks of at least one of the selection groups is less than said number of selections in said selection group;

a plurality of awards, wherein each said award is individually associated with a least one of the selections, and wherein each selection has one of said awards individually associated with said selection;

a display device;

an input device; and a processor operable to control the wagering game and operable with the display device and input device for each of the plurality of selection groups to:

(a) display said selection group of the secondary game, wherein the selections in said selection group are simultaneously displayed, (b) designate the selection group from which the player is enabled to pick, (c) enable the player to make the associated guaranteed number a picks of the selections in said selection group, wherein the player is enabled to pick less than the number of picks provided to the player for the designated group before being enabled to pick from another of said selection groups, and (d) display and provide to the player the awards associated with the picked selections in said selection group.

* * * * *